US008552951B2

(12) United States Patent
Chiang et al.

(10) Patent No.: US 8,552,951 B2
(45) Date of Patent: Oct. 8, 2013

(54) DRIVING METHOD FOR LIQUID CRYSTAL PANEL AND LCD

(75) Inventors: Yao-Ching Chiang, Tainan County (TW); Yu-Yeh Chen, Tainan County (TW)

(73) Assignee: Chimei Innolux Corporation, Miao-Li County (TW)

( * ) Notice: Subject to any disclaimer, the term of this patent is extended or adjusted under 35 U.S.C. 154(b) by 757 days.

(21) Appl. No.: 12/330,088

(22) Filed: Dec. 8, 2008

(65) Prior Publication Data

US 2010/0007595 A1 Jan. 14, 2010

(30) Foreign Application Priority Data

Jul. 8, 2008 (TW) ..... 97125689 A

(51) Int. Cl.
*G09G 3/36* (2006.01)

(52) U.S. Cl.
USPC ..... 345/98

(58) Field of Classification Search
None
See application file for complete search history.

(56) References Cited

U.S. PATENT DOCUMENTS

| | | | | |
|---|---|---|---|---|
| 6,806,854 | B2 * | 10/2004 | Cairns et al. | 345/87 |
| 7,050,032 | B2 * | 5/2006 | Tamura | 345/98 |
| 7,382,383 | B2 | 6/2008 | Shiomi et al. | |
| 2003/0184508 | A1 | 10/2003 | Lee | |
| 2005/0162367 | A1 * | 7/2005 | Kobayashi et al. | 345/98 |
| 2005/0225525 | A1 * | 10/2005 | Wu et al. | 345/89 |
| 2006/0279523 | A1 * | 12/2006 | Nitta et al. | 345/102 |
| 2007/0290964 | A1 * | 12/2007 | Yang | 345/87 |
| 2008/0106544 | A1 * | 5/2008 | Lee et al. | 345/214 |
| 2008/0158246 | A1 | 7/2008 | Ishii et al. | |

FOREIGN PATENT DOCUMENTS

| | | | |
|---|---|---|---|
| CN | 1542715 | A1 | 11/2004 |
| EP | 1465149 | A2 | 10/2004 |
| TW | 200504644 | A | 2/2005 |

OTHER PUBLICATIONS

Chinese Office Action for 200810214867.1 mailed Apr. 12, 2012.

* cited by examiner

*Primary Examiner* — Joseph Haley
*Assistant Examiner* — Emily Frank
(74) *Attorney, Agent, or Firm* — Lowe Hauptman & Ham, LLP

(57) ABSTRACT

In a driving method for a liquid crystal panel, overdriving pixel data is obtained either independently of the FRC pixel data or depending on a difference between the FRC pixel data and previous FRC pixel data.

17 Claims, 7 Drawing Sheets

DRIVING METHOD FOR LIQUID CRYSTAL PANEL AND LCD

This application claims the benefit of Taiwan application Serial No. 97125689, filed Jul. 8, 2008, the entire disclosure of which is incorporated herein by reference.

BACKGROUND

1. Technical Field

The disclosure relates in general to a driving method for a liquid crystal panel and a liquid crystal display (LCD), and more particularly to a liquid crystal panel with high display quality and a driving method for such LCD.

2. Related Art

A response time of liquid crystal molecules has much to do with a cross voltage at two ends of the liquid crystal molecules. Therefore, in order to increase the response rate of liquid crystal molecules, an overdriving technology is adopted to increase the response rate of liquid crystal molecules. An overdriving circuit is normally disposed near the liquid crystal panel. However, if a frame rate control (FRC) circuit is disposed before the overdriving circuit, the same gray level value will correspond to different pixel data on different image frames when a static image frame is inputted. This is because after a conversion procedure of frame rate control is applied to the pixel data, an error occurs due to data bit conversion (for example, 6-bit pixel data is converted to 8-bit pixel data) when the pixel data is processed in the overdriving circuit resulting in severe FRC noise.

Generally speaking, the overdriving circuit is implemented by a look up table. Referring to FIG. 1A, an overdriving look up table known to the inventors is shown. In a known LCD, an overdriving unit obtains overdriving pixel data from an overdriving look up table to drive corresponding pixels of a liquid crystal panel according to a boundary value and previous boundary value. The boundary value and the previous boundary value are obtained from the overdriving look up table. The boundary value corresponds to a current image frame. The previous boundary value corresponds to a previous image frame. When the boundary value is equal to the previous boundary value (the dotted area of FIG. 1A), the overdriving unit directly outputs the current image frame without adopting the overdriving technology.

Referring to FIG. 1B, a block diagram of the known LCD is shown. The LCD 100 includes a liquid crystal panel 105, a scan driving unit 110, a frame rate control (FRC) unit 120, a mapping unit 130, the buffer 140, an overdriving unit 150, a processing unit 160 and a data driving unit 170. The liquid crystal panel 105 has several pixels controlled by the scan driving unit 110.

The frame rate control unit 120 converts M-bit pixel data $D_{I_M}$ into N-bit FRC pixel data $D_{FRC_N}$ according to a conversion procedure of frame rate control, wherein M and N are positive integers, and M is larger than N. For example, the M-bit pixel data $D_{I_M}$ is a gray level value 25 corresponding to a static image frame, the N-bit FRC pixel data $D_{FRC_N}$ is one of the gray level values 7, 6, 6 and 6 corresponding to the dynamic image frame. The mapping unit 130 converts the FRC pixel data $D_{FRC_N}$ into a boundary value according to a boundary look up table (not shown). The buffer 140 stores the boundary value.

The overdriving unit 150 is coupled to the mapping unit 130 and the buffer 140 for obtaining a pixel data offset from the overdriving look up table (shown in FIG. 1A) (OD LUT) according to the boundary value and a previous boundary value. The processing unit 160 is coupled to the frame rate control unit 120 and the overdriving unit 150 for obtaining overdriving pixel data by adding the pixel data offset and the FRC pixel data. The data driving unit 170 drives corresponding pixels of the liquid crystal panel 105 according to the overdriving pixel data.

However, at the boundary of the range of the gray level value corresponding to the boundary value, after the frame rate control unit 120 converts the pixel data into FRC pixel data, the FRC pixel data may be changed and the previous boundary value (the dashed area of FIG. 1) will be changed accordingly. For example, if the FRC pixel data $D_{FRC_N}$ is a gray level value 6, the mapping unit 130 converts the gray level value 6 into a boundary value 6. If the FRC pixel data $D_{FRC_N}$ is a gray level value 7, the mapping unit 130 converts the gray level value 7 into a boundary value 13. Thus, for a gray level value 25 corresponding to the unchanged static image frame, if the FRC pixel data $D_{FRC_N}$ sequentially is gray level values 6 and 7, then the overdriving unit 150 obtains a pixel data offset (such as 2) according to the previous boundary value 6 and the boundary value 13. The processing unit 160 obtains the overdriving pixel data 9 according to the pixel data offset 2 and the FRC pixel data 7. However, the static image frame does not change. That is, the overdriving unit 150 generates errors and adopts the overdriving technology according to the boundary value and the changed previous boundary value, such that the liquid crystal panel 105 does not display the correct image.

To resolve the above problem, when the boundary value and the previous boundary value correspond to the areas besides diagonal lines of the overdriving look up table (that is, the dashed area of FIG. 1A), the overdriving technology is not adopted. However, despite that the problem associated with the frame rate control unit 120 is resolved, the overall display quality of the LCD adopting the overdriving technology decreases, and hardware resources are not fully utilized.

BRIEF DESCRIPTION OF THE DRAWINGS

One or more embodiments are illustrated by way of example, and not by limitation, in the figures of the accompanying drawings, wherein elements having the same reference numeral designations represent like elements throughout.

DETAILED DESCRIPTION OF EMBODIMENTS

One or more embodiments provide an LCD and a driving method for such LCD, so as to improve the effectiveness of the overdriving technology adopted in the LCD, resolve the problem of frame rate control (FRC) noises which occur in a static image frame, increase the utilization rate of the overdriving look up table and improve the overall LCD display quality.

First Embodiment

Figure 2A:
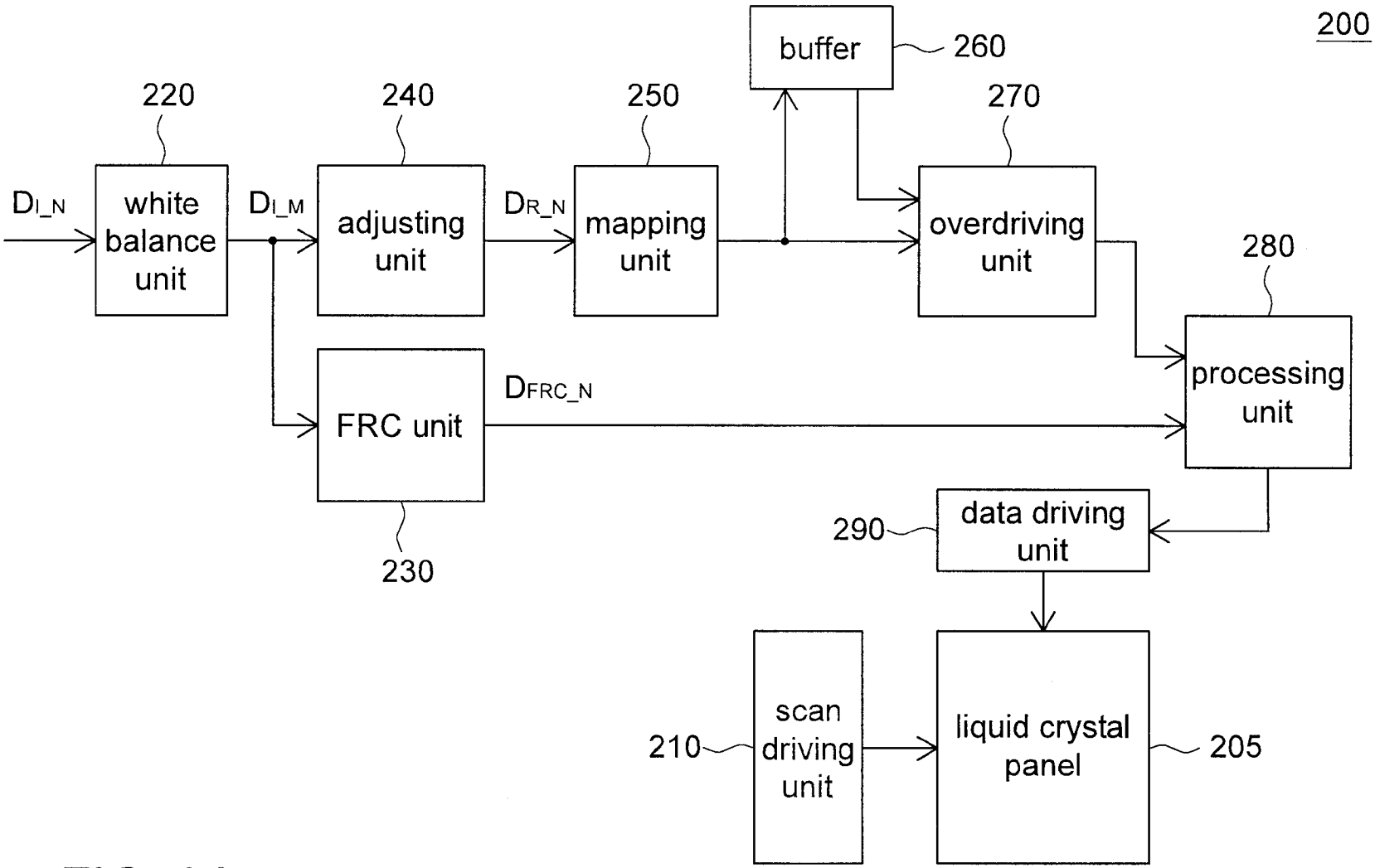
FIG. 2A shows a block diagram of an LCD according to a first embodiment.

Referring to FIG. 2A, a block diagram of an LCD according to a first embodiment is shown. The LCD 200 includes a liquid crystal panel 205, a scan driving unit 210, a white balance unit 220, a frame rate control unit 230, an adjusting unit 240, a mapping unit 250, a buffer 260, an overdriving unit 270, a processing unit 280 and a data driving unit 290. The liquid crystal panel 205 has several pixels controlled by the scan driving unit 210.

The white balance unit 220 calibrates N-bit original pixel data $D_{I_N}$ as M-bit pixel data $D_{I_M}$ according to a white balance look up table (not shown), wherein M and N are positive integers, and M is larger than N. The frame rate control unit 230 converts the M-bit pixel data $D_{I_M}$ into N-bit FRC pixel data $D_{FRC_N}$ according to a conversion procedure of frame rate control. The conversion procedure of frame rate control simulates a static image frame having a higher resolution with a dynamic image frame having a lower resolution. In the first embodiment, the FRC pixel data $D_{FRC_N}$ is transmitted directly to the processing unit 280 without affecting the operation of the overdriving unit 270.

In response to the N-bit FRC pixel data $D_{FRC_N}$ outputted from the frame rate control unit 230, the adjusting unit 240 also adjusts the M-bit pixel data $D_{I_M}$ to N-bit reference pixel data $D_{R_N}$, wherein the reference pixel data $D_{R_N}$ differs from the pixel data $D_{I_M}$ by (M-N) least significant bits. For example, the original pixel data $D_{I_N}$ is 6-bit pixel data, but the pixel data $D_{I_M}$ is 8-bit pixel data after the pixel data is calibrated by the white balance unit 220. The adjusting unit 240 adjusts 8-bit pixel data $D_{I_M}$ to 6-bit reference pixel data $D_{R_N}$. Thus, the reference pixel data $D_{R_N}$ differs from the pixel data $D_{I_M}$ by 2 bits. The adjusting unit 240 can obtain the reference pixel data $D_{R_N}$ by directly discarding the (M-N) least significant bits of the pixel data $D_{I_M}$ or adopting an unconditional rounding method.

The mapping unit 250 converts the reference pixel data $D_{R_N}$ into a boundary value according to a boundary look up table (not shown). The buffer 260 stores the boundary value. The overdriving unit 270 is coupled to the mapping unit 250 and the buffer 260 for obtaining a pixel data offset from an overdriving look up table (OD LUT) (not shown) according to the boundary value and a previous boundary value. As the conversion procedure of frame rate control is not applied to the reference pixel data $D_{R_N}$, the reference pixel data $D_{R_N}$ does not fluctuate. Thus, the pixel data offset obtained by the overdriving unit 270 is free of FRC noise.

For example, if the M-bit pixel data $D_{I_M}$ is the gray level value 25 corresponding to the static image frame and the N-bit FRC pixel data $D_{FRC_N}$ is one of the gray level values 7, 6, 6 and 6 corresponding to the dynamic image frame, then the adjusting unit 240 adjusts the pixel data $D_{I_M}$ to reference pixel data $D_{R_N}$ such as the gray level values 6, 6, 6 and 6 for example. Thus, the boundary values obtained by the mapping unit 250 are all 6. That is, for the gray level value 25 corresponding to an un-changed static image frame, if the FRC pixel data $D_{FRC_N}$ is sequentially gray level values 6 and 7, the overdriving unit 270 obtains a pixel data offset 0 according to the previous boundary value 6 and the boundary value 6. The overdriving unit 270 does not have any FRC-related errors.

The processing unit 280 is coupled to the frame rate control unit 230 and the overdriving unit 270 for obtaining overdriving pixel data by adding the pixel data offset and the FRC pixel data $D_{FRC_N}$. The data driving unit 290 drives the pixel corresponding to the liquid crystal panel 205 according to the overdriving pixel data.

Figure 2B:
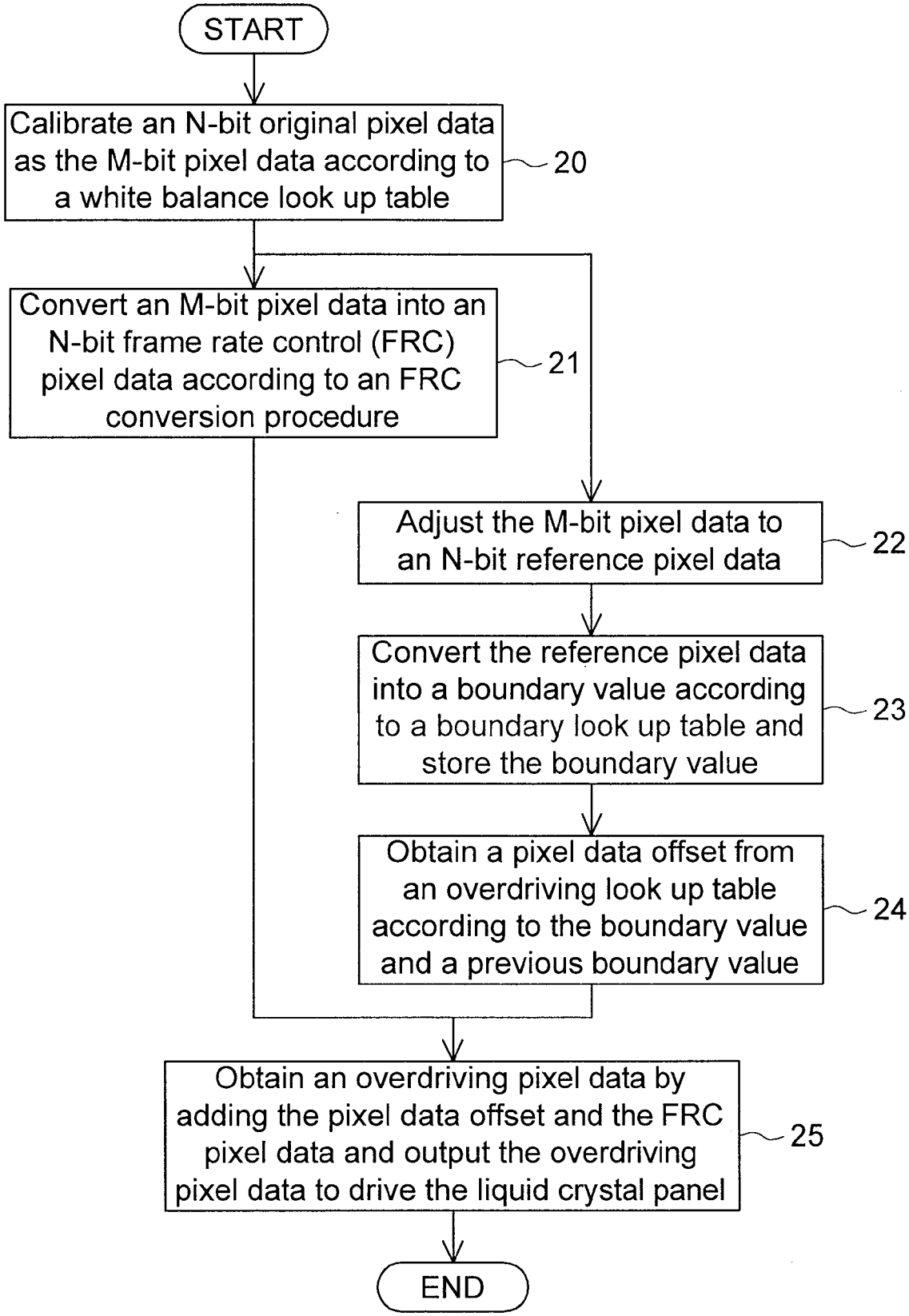
FIG. 2B shows a flowchart of a driving method for a liquid crystal panel according to the first embodiment.

Referring to FIG. 2B, a flowchart of a driving method for a liquid crystal panel according to the first embodiment is shown. Firstly, the method begins at step 20, N-bit original pixel data is calibrated as M-bit pixel data according to a white balance look up table, wherein M and N are positive integers, and M is larger than N. Then, the method proceeds to step 21, the M-bit pixel data is converted into N-bit FRC pixel data according to a conversion procedure of frame rate control.

Then, the method proceeds to step 22, the M-bit pixel data is adjusted to N-bit reference pixel data, wherein the reference pixel data differs from the pixel data by (M-N) least significant bits. Next, the method proceeds to step 23, the reference pixel data is converted into a boundary value according to a boundary look up table and the boundary value is stored. Then, the method proceeds to step 24, a pixel data offset is obtained from an overdriving look up table according to the boundary value and a previous boundary value.

Afterwards, the method proceeds to step 25, overdriving pixel data is obtained by adding the pixel data offset and the FRC pixel data, and then the overdriving pixel data is outputted to drive the corresponding pixels of the liquid crystal panel.

According to the driving method and the LCD disclosed in the first embodiment, the FRC pixel data and the reference pixel data are transmitted via different paths, such that the FRC pixel data does not affect the overdriving unit 270, and the pixel data offset obtained by the overdriving unit 270 is free of any FRC noise. Thus, the problem of erroneous operations occurring in the known LCD when the overdriving unit processes the FRC pixel data is resolved, and the overall LCD display quality is improved.

Second Embodiment

Figure 3A:
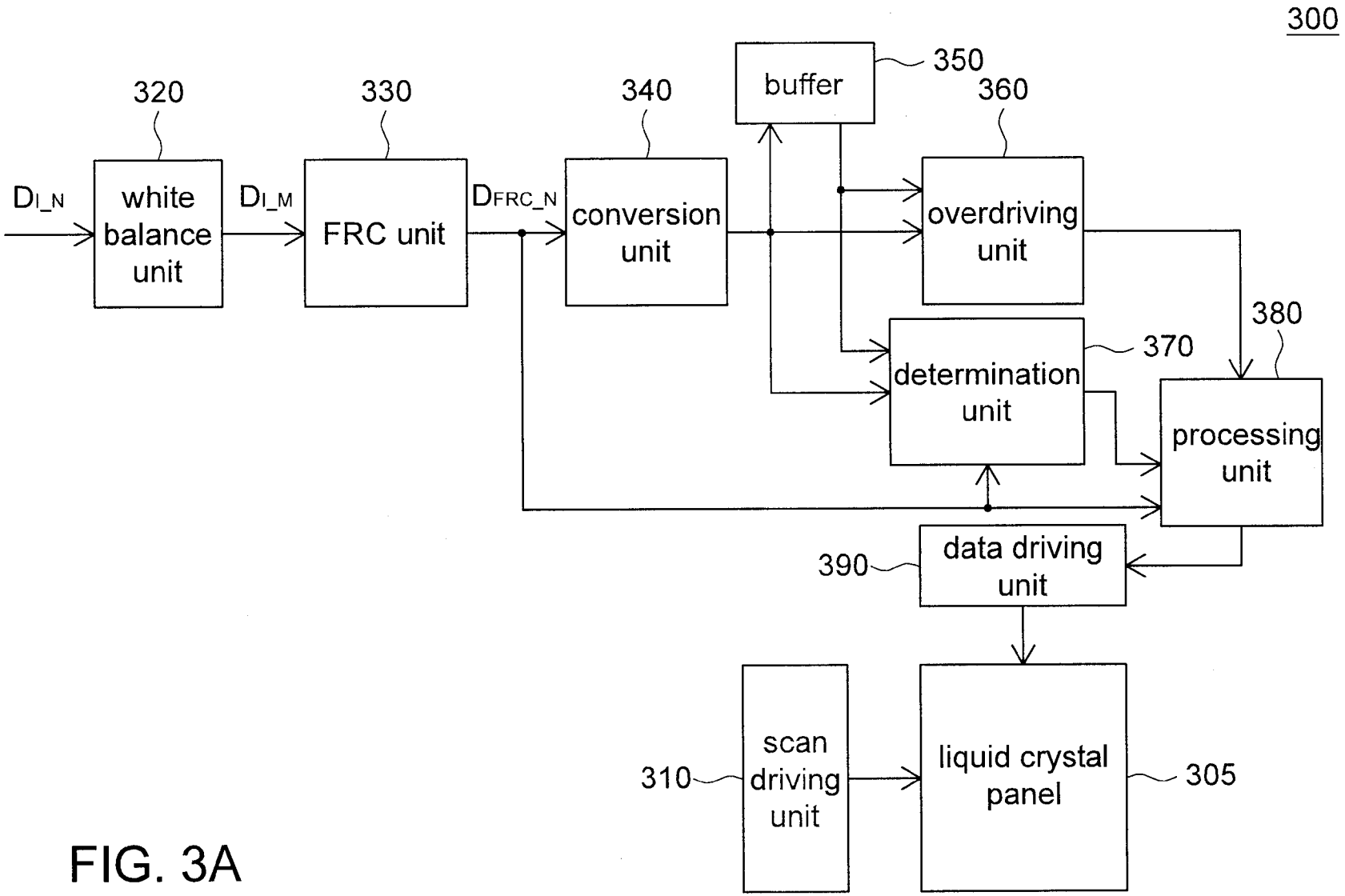
FIG. 3A shows a block diagram of an LCD according to a second embodiment.

Referring to FIG. 3A, a block diagram of an LCD according to a second embodiment is shown. The LCD 300 includes a liquid crystal panel 305, a scan driving unit 310, a white balance unit 320, a frame rate control (FRC) unit 330, a conversion unit 340, a buffer 350, an overdriving unit 360, a determination unit 370, a processing unit 380 and a data driving unit 390. The liquid crystal panel 305 has several pixels controlled by the scan driving unit 310.

The white balance unit 320 calibrates N-bit original pixel data $D_{I_N}$ as M-bit pixel data $D_{I_M}$ according to a white balance look up table (not shown), wherein M and N are positive integers, and M is larger than N. The frame rate control unit 330 converts the M-bit pixel data $D_{I_M}$ into N-bit FRC pixel data $D_{FRC_N}$ according to a conversion procedure of frame rate control. The conversion procedure of frame rate control simulates a static image frame having a higher resolution with a dynamic image frame having a lower resolution.

The conversion unit 340 determines a boundary value corresponding to the FRC pixel data $D_{FRC_N}$. The conversion unit 340 substantially determines the boundary value corresponding to the FRC pixel data $D_{FRC_N}$ by replacing the boundary look up table (not shown) according to a dichotomizing method so as to achieve cost/benefit effectiveness. The buffer 350 stores the boundary value. The overdriving unit 360 is coupled to the conversion unit 340 and the buffer 350 for obtaining a pixel data offset from an overdriving look up table (OD LUT) (shown in FIG. 3B) according to the boundary value and a previous boundary value.

Figure 1A:
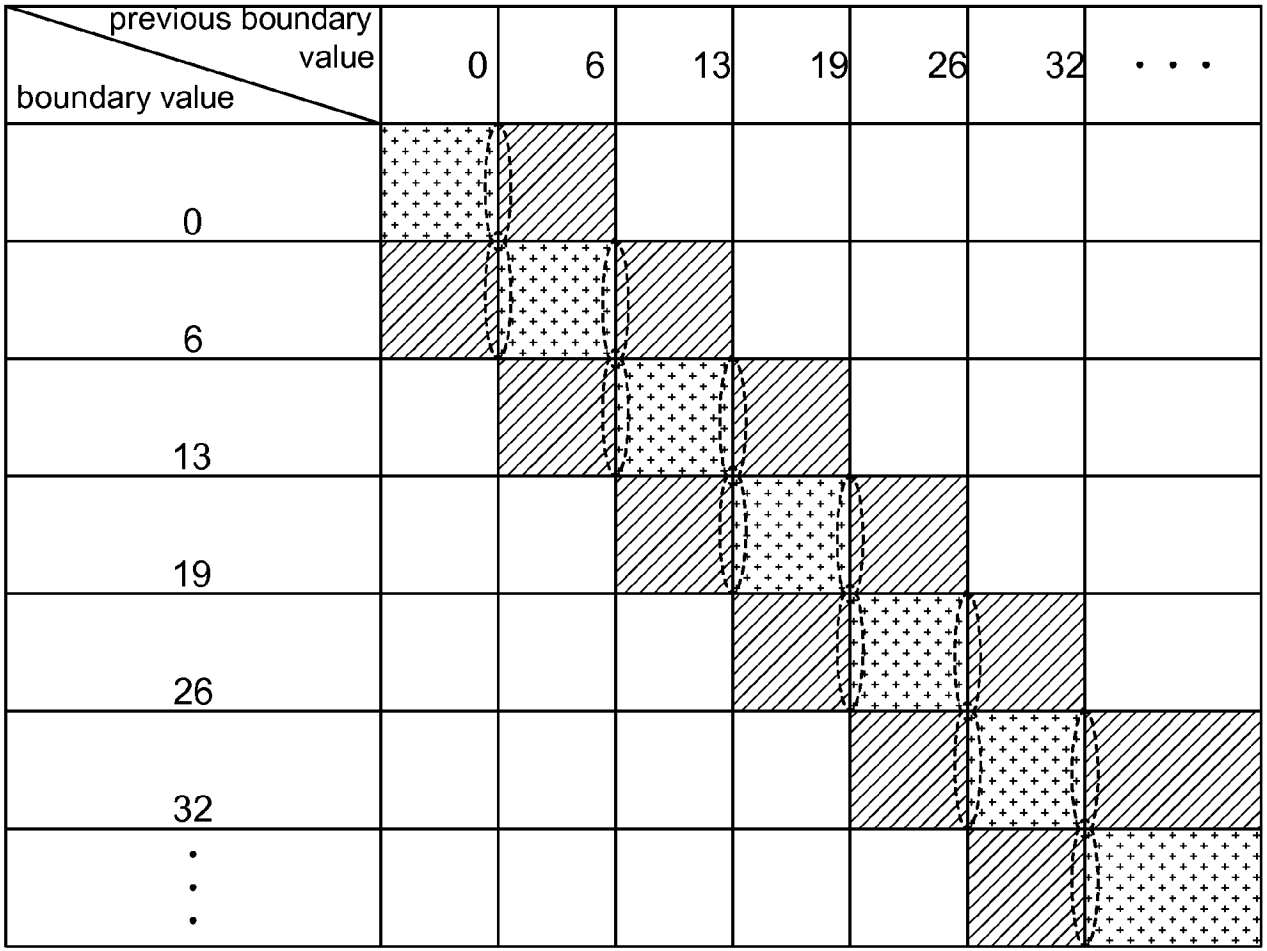
FIG. 1A Prior Art
FIG. 1A shows a known overdriving look up table.
Figure 1B:
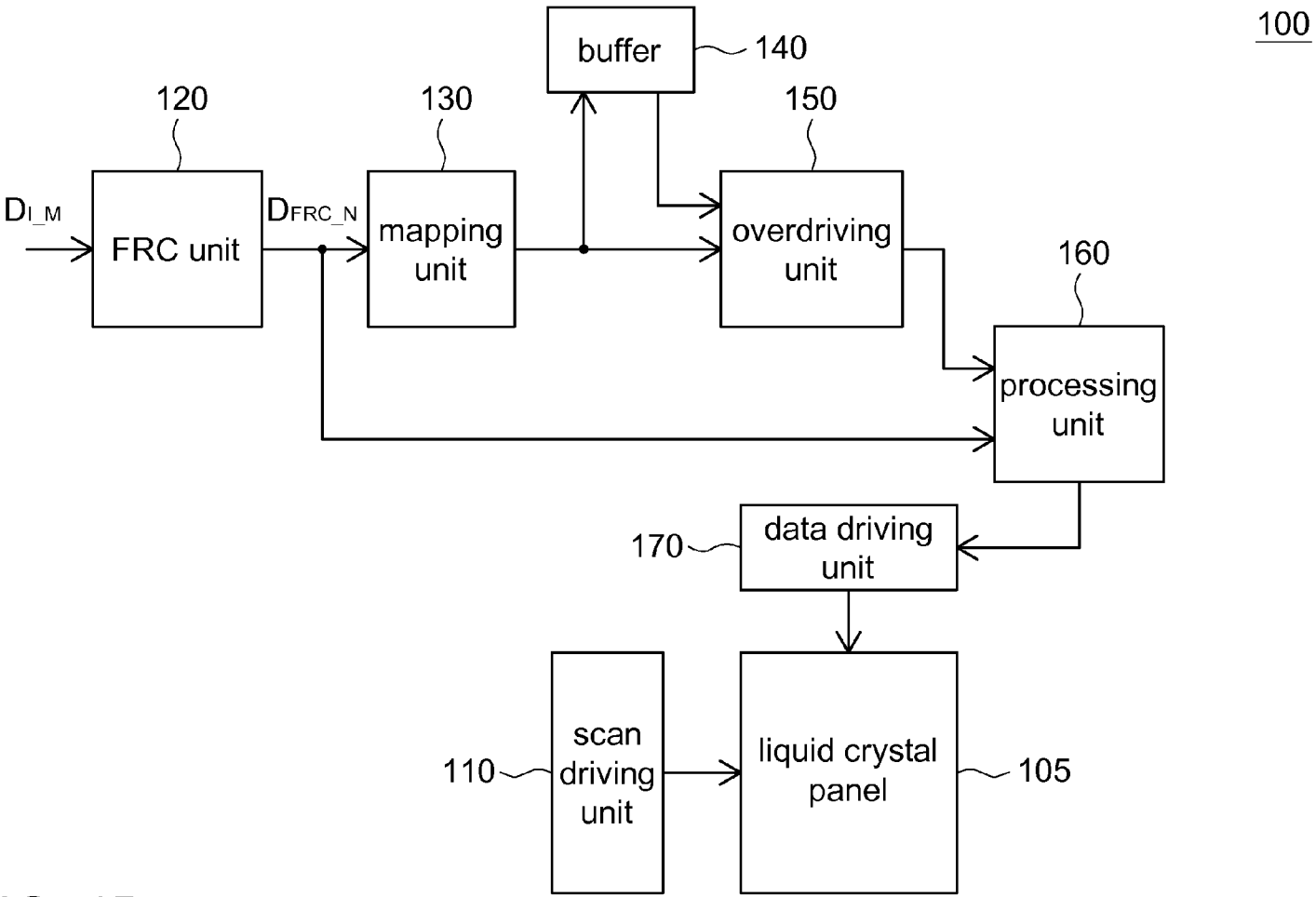
FIG. 1B Prior Art
FIG. 1B shows a block diagram of a known LCD.
Figure 3B:
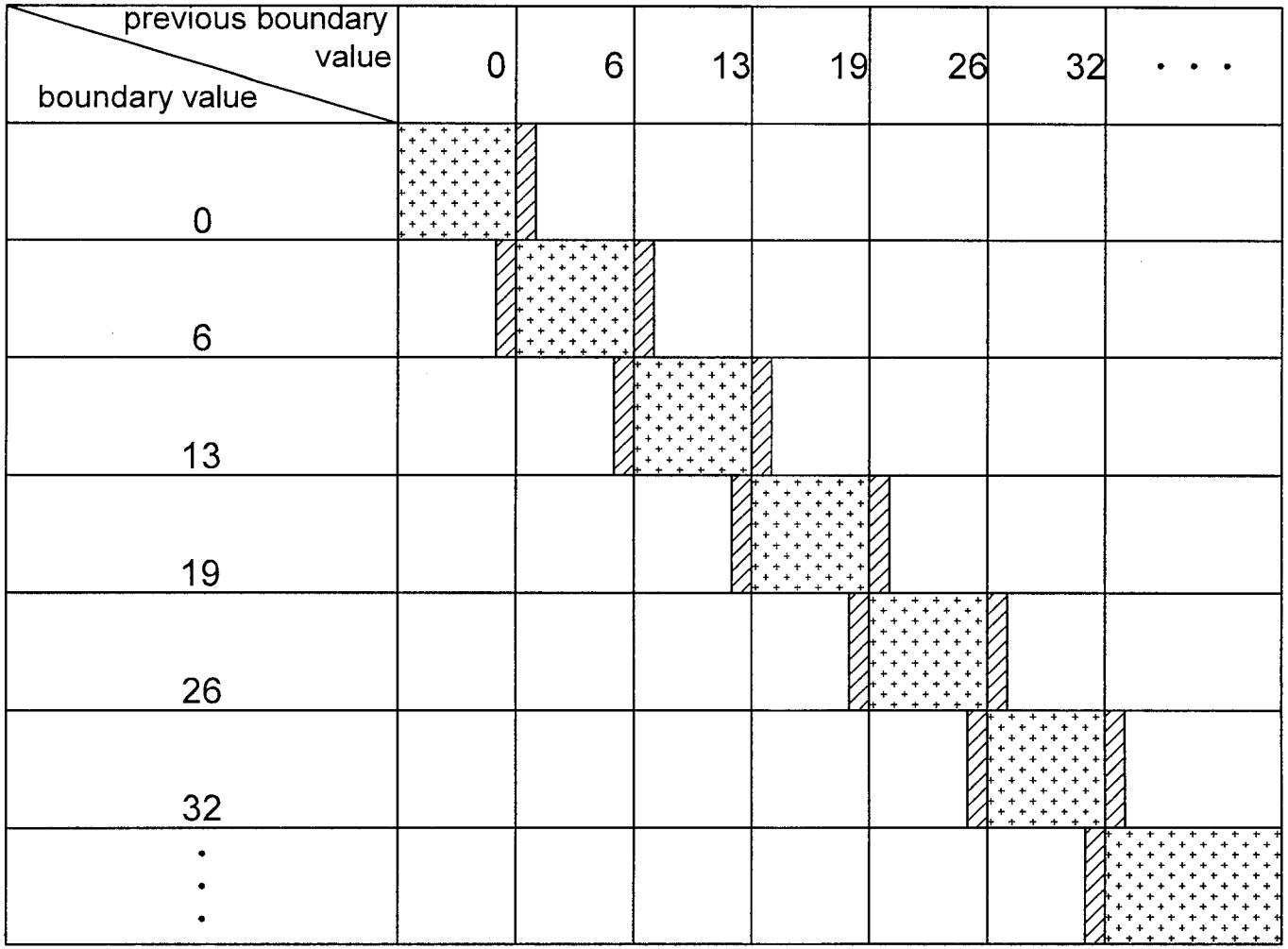
FIG. 3B shows an overdriving look up table according to the second embodiment.

The determination unit 370 determines whether the difference between previous FRC pixel data and the range of the gray level value corresponding to the boundary value is larger than 1, wherein the previous FRC pixel data corresponds to the previous boundary value. Referring to FIG. 3B, an overdriving look up table according to the second embodiment is shown. The dotted area shows that the boundary value is equal to the previous boundary value. In the overdriving look up table, the FRC pixel data $D_{FRC_N}$ may be changed only in the dashed area of FIG. 3B, where the difference between the previous FRC pixel data and the range of the gray level value corresponding to the boundary value is 1. The difference in some embodiments can be 2, 3 etc, provided that the dashed area of FIG. 3B defined by such difference is smaller than that of FIG. 1B. Thus, when the determination unit 370 determines that the corresponding relationship between the previous FRC pixel data and the boundary value is located in the dashed area or the dotted area, the LCD 300 does not overdrive, and the processor 380 outputs the FRC pixel data $D_{FRC_N}$ outputted from the frame rate control unit 330 as overdriving pixel data. Thus, FRC noise is avoided.

If the determination unit 370 determines that the difference between the previous FRC pixel data and the range of the gray level value corresponding to the boundary value is larger than 1 (that is, the area other than the dotted area and the dashed area of FIG. 3B), the processing unit 380 obtains the overdriving pixel data by adding the pixel data offset outputted from the overdriving unit 360 and the FRC pixel data $D_{FRC_N}$. The data driving unit 390 drives the corresponding pixels of the liquid crystal panel 305 according to the overdriving pixel data.

Figure 3C:
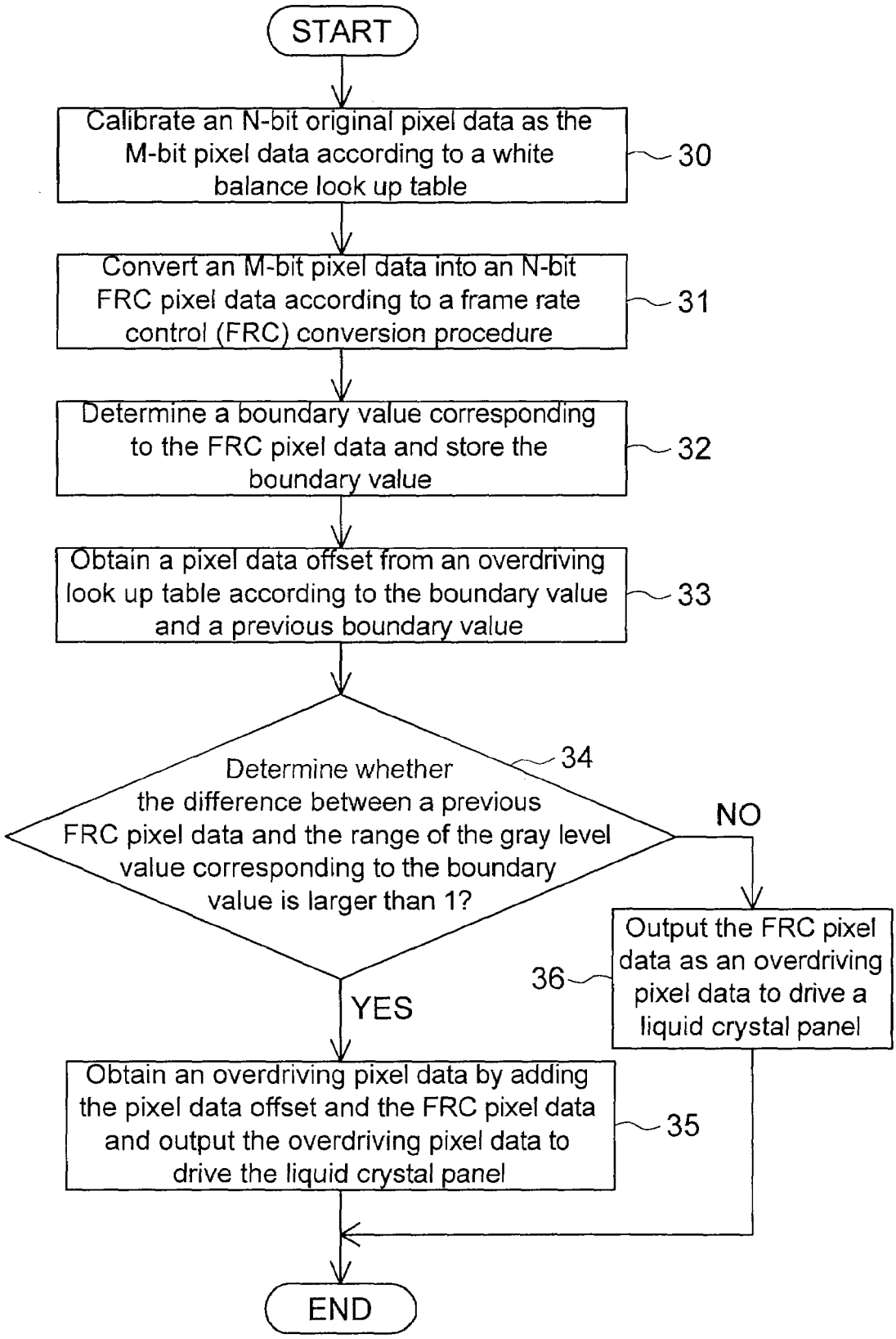
FIG. 3C shows a flowchart of a driving method for a liquid crystal panel according to the second embodiment.

The second embodiment also discloses a driving method for a liquid crystal panel. Referring to FIG. 3C, a flowchart of a driving method for a liquid crystal panel according to the second embodiment is shown. Firstly, the method begins at step 30, N-bit original pixel data is calibrated as M-bit pixel data according to a white balance look up table, wherein M and N are positive integers, and M is larger than N. Then, the method proceeds to step 31, the M-bit pixel data is converted into N-bit FRC pixel data according to a conversion procedure of frame rate control.

Next, the method proceeds to step 32, a boundary value corresponding to the FRC pixel data is determined and stored. Step 32 substantially determines the boundary value by replacing the boundary look up table according to a dichotomizing method so as to achieve cost/benefit effectiveness. Then, the method proceeds to step 33, a pixel data offset is obtained from the overdriving look up table (shown in FIG. 3B) according to the boundary value and a previous boundary value. After that, the method proceeds to step 34, to determine whether the difference between previous FRC pixel data and the range of the gray level value corresponding to the boundary value is larger than 1, wherein the previous FRC pixel data corresponds to the previous boundary value.

If the difference between the previous FRC pixel data and the range of the gray level value corresponding to the boundary value is larger than 1, then the method proceeds to step 35, overdriving pixel data is obtained by adding the pixel data offset and the FRC pixel data and then the overdriving pixel data is outputted to drive the corresponding pixels of the liquid crystal panel. If the difference between the previous FRC pixel data and the range of the gray level value corresponding to the boundary value is smaller than or equal to 1 or if the previous FRC pixel data is within the range of the gray level value corresponding to the boundary value, then the method proceeds to step 36, the FRC pixel data is outputted as overdriving pixel data to drive the corresponding pixels of the liquid crystal panel.

According to the driving method for a liquid crystal panel and the LCD disclosed in the second embodiment, except for the situations when the boundary value and the previous boundary value are identical or when the FRC pixel data may fluctuate, that is, the difference between the previous FRC pixel data and the range of the gray level value corresponding to the boundary value is smaller than or equal to 1, the LCD does not overdrive. Thus, the problem of erroneous operations occurring in the known LCD when the overdriving unit processes the FRC pixel data is resolved, and the overall LCD display quality is improved.

What is claimed is:

1. A driving method of driving a liquid crystal panel, the method comprising:

converting M-bit pixel data into N-bit FRC pixel data according to a frame rate control (FRC) conversion procedure, where M and N are positive integers, and M is larger than N;

independently of the N-bit FRC pixel data, generating a pixel data offset from the M-bit pixel data received via a different path from a path of the N-bit FRC pixel data;

determining overdriving pixel data according to (i) the pixel data offset and (ii) the N-bit FRC pixel data; and outputting the overdriving pixel data to drive the liquid crystal panel.

2. The driving method according to claim 1, wherein the generating comprises:

adjusting the M-bit pixel data to N-bit reference pixel data;

converting the N-bit reference pixel data into a boundary value; and outputting the pixel data offset according to the boundary value and a previous boundary value.

3. The driving method according to claim 2, wherein the adjusting comprises adjusting the M-bit pixel data to the N-bit reference pixel data such that the N-bit reference pixel data differs from the M-bit pixel data by (M-N) least significant bits.

4. The driving method according to claim 3, wherein the adjusting further comprises generating the N-bit reference pixel data by discarding the (M-N) least significant bits of the M-bit pixel data or adopting an unconditional rounding method.

5. The driving method according to claim 2, further comprising:

calibrating N-bit original pixel data as the M-bit pixel data according to a white balance look up table.

6. The driving method according to claim 2, wherein the boundary value is stored after converting the N-bit reference pixel data into the boundary value; and the pixel data offset is determined, from an overdriving look up table, according to the boundary value and the previous boundary value.

7. The driving method according to claim 2, wherein the M-bit pixel data is a gray level value corresponding to a static image frame, the N-bit FRC pixel data is a gray level value corresponding to a dynamic image frame, and the boundary value is for the gray level value corresponding to the static image frame.

8. The driving method according to claim 1, further comprising:

directly transmitting the N-bit FRC pixel data, after being converted, for use in the determining.

9. A control circuit for a liquid crystal display (LCD), the control circuit comprising:

a frame rate control (FRC) unit for converting M-bit pixel data into N-bit FRC pixel data according to a conversion procedure of frame rate control, where M and N are positive integers, and M is larger than N;

an overdriving unit for outputting, independently of the N-bit FRC pixel data, a pixel data offset from the M-bit pixel data inputted into the overdriving unit via a different path from a path of the N-bit FRC pixel data;

a processing unit for obtaining overdriving pixel data according to inputs of (i) the pixel data offset and (ii) the N-bit FRC pixel data into the processing unit; and a data driving unit for driving the liquid crystal panel according to the overdriving pixel data.

10. The control circuit according to claim 9, further comprising, along the different path:

an adjusting unit for adjusting the M-bit pixel data to N-bit reference pixel data; and a mapping unit for converting the N-bit reference pixel data into a boundary value according to a boundary look up table;

wherein the overdriving unit is coupled to the mapping unit for determining the pixel data offset according to the boundary value and a previous boundary value.

11. The control circuit according to claim 10, wherein the adjusting unit is configured to adjust the M-bit pixel data to the N-bit reference data such that the N-bit reference pixel data differs from the M-bit pixel data by (M-N) least significant bits.

12. The control circuit according to claim 11, wherein the adjusting unit is configured to output the N-bit reference pixel data by discarding the (M-N) least significant bits of the M-bit pixel data or adopting an unconditional rounding method.

13. The control circuit according to claim 10, further comprising a white balance unit coupled to the FRC unit and the adjusting unit for calibrating N-bit original pixel data as the M-bit pixel data according to a white balance look up table.

14. The control circuit according to claim 10, further comprising:

a buffer for storing the boundary value; and an overdriving look up table according to which the overdriving unit is configured to output the pixel data offset based on the boundary value and the previous boundary value.

15. The control circuit according to claim 10, wherein the M-bit pixel data is a gray level value corresponding to a static image frame, the N-bit FRC pixel data is a gray level value corresponding to a dynamic image frame, and the boundary value is for the gray level value corresponding to the static image frame.

16. A liquid crystal display, comprising:

an LCD panel comprising a plurality of pixels, and a control circuit according to claim 9 connected to the LCD panel for driving the pixels.

17. The control circuit according to claim 9, wherein the FRC unit is configured to directly output the N-bit FRC pixel data to the processing unit.

* * * * *